US008103437B2

(12) United States Patent
Nagase et al.

(10) Patent No.: US 8,103,437 B2
(45) Date of Patent: Jan. 24, 2012

(54) TRAFFIC INFORMATION DISTRIBUTION APPARATUS AND TRAFFIC INFORMATION DISTRIBUTION METHOD

(75) Inventors: Kenji Nagase, Aichi (JP); Takayasu Nakada, Okazaki (JP); Kazutaka Yoshikawa, Okazaki (JP); Toshio Inoguchi, Nagoya (JP)

(73) Assignees: Aisin Aw Co., Ltd., Anjo-Shi, Aichi (JP); Toyota Jidosha Kabushiki Kaisha, Aichi-Ken (JP)

( * ) Notice: Subject to any disclaimer, the term of this patent is extended or adjusted under 35 U.S.C. 154(b) by 311 days.

(21) Appl. No.: 12/442,280

(22) PCT Filed: Oct. 15, 2007

(86) PCT No.: PCT/JP2007/070498

§ 371 (c)(1), (2), (4) Date: Mar. 20, 2009

(87) PCT Pub. No.: WO2008/050696

PCT Pub. Date: May 2, 2008

(65) Prior Publication Data

US 2009/0248286 A1 Oct. 1, 2009

(30) Foreign Application Priority Data

Oct. 18, 2006 (JP) ..... 2006-283523

(51) Int. Cl.
*G08G 1/00* (2006.01)

(52) U.S. Cl. ..... 701/118

(58) Field of Classification Search ..... 701/118; 340/934

See application file for complete search history.

(56) References Cited

U.S. PATENT DOCUMENTS

| | | | | |
|---|---|---|---|---|
| 6,292,742 | B1 | 9/2001 | Heimann et al. | 701/117 |
| 7,908,076 | B2 * | 3/2011 | Downs et al. | 701/117 |
| 7,920,960 | B2 * | 4/2011 | Liu et al. | 701/118 |
| 2006/0004511 | A1 | 1/2006 | Yoshikawa et al. | 701/200 |

FOREIGN PATENT DOCUMENTS

| | | |
|---|---|---|
| DE | 19629233 | 1/1998 |
| DE | 19651143 | 6/1998 |
| DE | 19843203 | 3/2000 |
| DE | 19856704 | 6/2000 |
| JP | 2003-302229 | 10/2003 |
| JP | 2006-017482 | 1/2006 |
| JP | 2006-091476 | 4/2006 |

* cited by examiner

*Primary Examiner* — Mark Beauchaine

(74) *Attorney, Agent, or Firm* — Bacon & Thomas, PLLC

(57) ABSTRACT

In a case where a CPU 11 provided in an information distribution center 3 has received a request command for requesting predicted traffic information transmitted from a navigation apparatus 2 as well as vehicle information such as a navigator identifying ID, coordinate data of a vehicle position, or coordinate data of a destination, the CPU 11 searches a basic route based on update-purpose map information 14A, and sets a distribution range serving as a transmission target of traffic information 16A, 16B, and 16C. Then, the CPU 11 generates the predicted traffic information 16C such as congestion prediction information corresponding to the distribution range, extracts the predicted traffic information 16C of each link having a difference in the generated predicted traffic information 16C and the current traffic information 16A, and distributes the extracted predicted traffic information 16C to the navigation apparatus 2 together with a link ID of a corresponding link.

5 Claims, 6 Drawing Sheets

TRAFFIC INFORMATION DISTRIBUTION APPARATUS AND TRAFFIC INFORMATION DISTRIBUTION METHOD

TECHNICAL FIELD

The present invention relates to a traffic information distributing apparatus and a traffic information distributing method that distributes traffic information according to a transmission request received from a navigation apparatus installed in a vehicle.

BACKGROUND ART

In recent years, various types of navigation apparatuses that receive traffic information from a Vehicle Information and Communication System (VICS: a registered trademark) via a radio wave beacon, an optical beacon or frequency modulation multiple broadcasting have been disclosed.

Also, various types of traffic information distributing apparatuses and traffic information distributing methods that distribute traffic information according to a transmission request received from a navigation apparatus installed in a vehicle have been proposed.

One example is a traffic information distributing apparatus that, in a case where a downloading request for downloading traffic information around a current position is transmitted from the navigation apparatus, reads traffic information, congestion prediction data and congestion statistical data distributed from the Vehicle Information and Communication System (VICS: a registered trademark) from a traffic information database (DB), and sends them to the navigation apparatus (see, for example, Japanese Patent Application Publication No. JP-A-2003-302229, paragraphs 0010 to 0054 and FIGS. 1 to 13).

In the navigation apparatus installed in the vehicle, the traffic information, the congestion prediction data or the like received from the Vehicle Information and Communication System (VICS: a registered trademark) and the traffic information distributing apparatus are used for searching or guiding a route to a destination.

DISCLOSURE OF THE INVENTION

Problem to be Solved by the Invention

The above navigation apparatus receiving the traffic information, the congestion prediction data or the like from the Vehicle Information and Communication System (VICS: a registered trademark) and the traffic information distributing apparatus, however, has a problem that the navigation apparatus may receive predicted traffic information having no difference in a traffic condition from that of current traffic information already received (hereinafter, the current traffic information) from the traffic information distributing apparatus. That is, the predicted traffic information is distributed even in a case where the traffic condition of the current traffic information and the predicted traffic information have no difference. Thus, a problem arises where the amount of communication information is increased unnecessarily and thereby the communication cost becomes higher. Also in a case where only congestion prediction traffic information is distributed in order to reduce the amount of the communication information, even in case where the congestion of the current traffic information is resolved in the predicted traffic information, update information for updating such information is not distributed. Thus, another problem arises where accurate distribution of the predicted traffic information becomes difficult.

In order to solve the problems described above, it is an object of the present invention to provide a traffic information distribution apparatus and a traffic information distribution method that makes it possible to reduce the amount of the communication information to keep the communication cost at a low level, while making it possible to accurately distribute the predicted traffic information.

Means for Solving the Problem

In order to achieve the object of the present invention described above, the traffic information distributing apparatus according to a first aspect is a traffic information distributing apparatus that distributes traffic information and includes: a vehicle information receiving unit that receives vehicle information from a navigation apparatus installed in a vehicle; a current traffic information obtaining unit that obtains current traffic information; a predicted traffic information generating unit that generates predicted traffic information according to the time the vehicle arrives at each road link, based on the vehicle information; a predicted traffic information extracting unit that extracts predicted traffic information of a road having a difference in the predicted traffic information and the current traffic information; and a traffic information distribution controlling unit that controls so that the predicted traffic information extracted by the predicted traffic information extracting unit is distributed to the navigation apparatus.

The traffic information distributing apparatus according to a second aspect is the traffic information distributing apparatus according to the first aspect further including a distribution range setting unit that sets a distribution range serving as a transmission target of the traffic information based on the vehicle information, and in which the predicted traffic information generating unit generates the predicted traffic information according to the distribution range.

The traffic information distributing apparatus according to a third aspect is the traffic information distributing apparatus according to the first or second aspect in which the vehicle information includes congested road information that indicates the presence of congestion, and no-congestion road information that indicates the absence of congestion, and in a case where the current traffic information is the congested road information and the predicted traffic information is the no-congestion road information, the predicted traffic information extracting unit extracts the no-congestion road information.

The traffic information distributing method according to a fourth aspect is a traffic information distributing method distributing traffic information and includes: the steps of receiving vehicle information from a navigation apparatus installed in a vehicle; obtaining current traffic information; generating predicted traffic information according to the time the vehicle arrives at each road, based on the vehicle information; extracting predicted traffic information of the road having a difference in the predicted traffic information and the current traffic information; and controlling so that the predicted traffic information extracted in the predicted traffic information extracting step is distributed to the navigation apparatus.

The traffic information distributing apparatus according to the first aspect configured as described above generates the predicted traffic information (e.g., congestion of roads, traffic control, travel time of each link) according to the time the vehicle arrives at each road based on the vehicle information received from the navigation apparatus installed in the vehicle. Then the distributing apparatus extracts the predicted traffic information of the road having a difference in the generated predicted traffic information and the current traffic information (e.g. congestion, traffic control, travel time of each link) and distributes the information to the navigation apparatus.

With this arrangement, the traffic information distributing apparatus extracts only the predicted traffic information of the road having a difference in the generated predicted traffic information and the current traffic information, and distributes the information to the navigation apparatus. Thus, it is possible to reduce the amount of communication information and thereby to keep the communication cost at a low level. Also, the traffic information distributing apparatus extracts all of the predicted traffic information that is different from the current traffic information with respect to each of the roads and distributes the information to the navigation apparatus. Thus, it is possible to correctly distribute the predicted traffic information. Eventually, it is possible for the navigation apparatus to perform route searching with higher accuracy based on the correct predicted traffic information.

The traffic information distributing apparatus according to the second aspect sets the distribution range serving as the transmission target of the traffic information based on the vehicle information received from the navigation apparatus installed in the vehicle, and generates the predicted traffic information according to the distribution range. Then, the distributing apparatus extracts predicted traffic information of the road having a difference in the predicted traffic information and the current traffic information according to the distribution range, and distributes the information to the navigation apparatus.

With this arrangement, the traffic information distributing apparatus distributes, to the navigation apparatus, the predicted traffic information that is different from the current traffic information according to the distribution range. Thus, it is possible to reduce the amount of the communication information and thereby to keep the communication cost at a further lower level, while distributing adequate amount of the predicted traffic information as needed for the navigation apparatus to perform route searching.

The traffic information distributing apparatus according to the third aspect extracts, in a case where the current traffic information is the congested road information indicating the presence of congestion, and the predicted traffic information is the no-congestion road information indicating the absence of congestion, the no-congestion road information as the predicted traffic information and distributes the information to the navigation apparatus.

With this arrangement, it is possible for the traffic information distributing apparatus to accurately distribute the predicted no-congestion road information even in a case where the amount of the communication information is reduced to lower the communication cost. Thereby, it is possible for the navigation apparatus to perform route searching without missing any links included in the no-congestion road information.

The traffic information distributing method according to the forth aspect includes generating the predicted traffic information (e.g., congestion of roads, traffic control, travel time of each link) according to the time the vehicle arrives at each road based on the vehicle information received from the navigation apparatus installed in the vehicle. The distributing method also includes extracting the predicted traffic information of the road having a difference in the generated predicted traffic information and the current traffic information (e.g., congestion of roads, traffic control, travel time of each link), and distributing the information to the navigation apparatus.

With this method, only the predicted traffic information of the road having a difference in the predicted traffic information generated based on the vehicle information and the current traffic information, and distributes the extracted predicted traffic information to the navigation apparatus. Thus, it is possible to reduce the amount of communication information and thereby to keep the communication cost at a low level. Also, all of the predicted traffic information that is different from the current traffic information with respect to each road is extracted and distributed to the navigation apparatus. Thus, it is possible to correctly distribute the predicted traffic information. Eventually, it is possible for the navigation apparatus to perform route searching with higher accuracy based on the correct predicted traffic information.

BEST MODES FOR CARRYING OUT THE INVENTION

A traffic information distributing apparatus and a traffic information distributing method according to the present invention will be explained in detail with reference to the accompanying drawings, through an exemplary embodiment in which the traffic information distributing apparatus and the traffic information distributing method are materialized in a navigation system.

Figure 1:
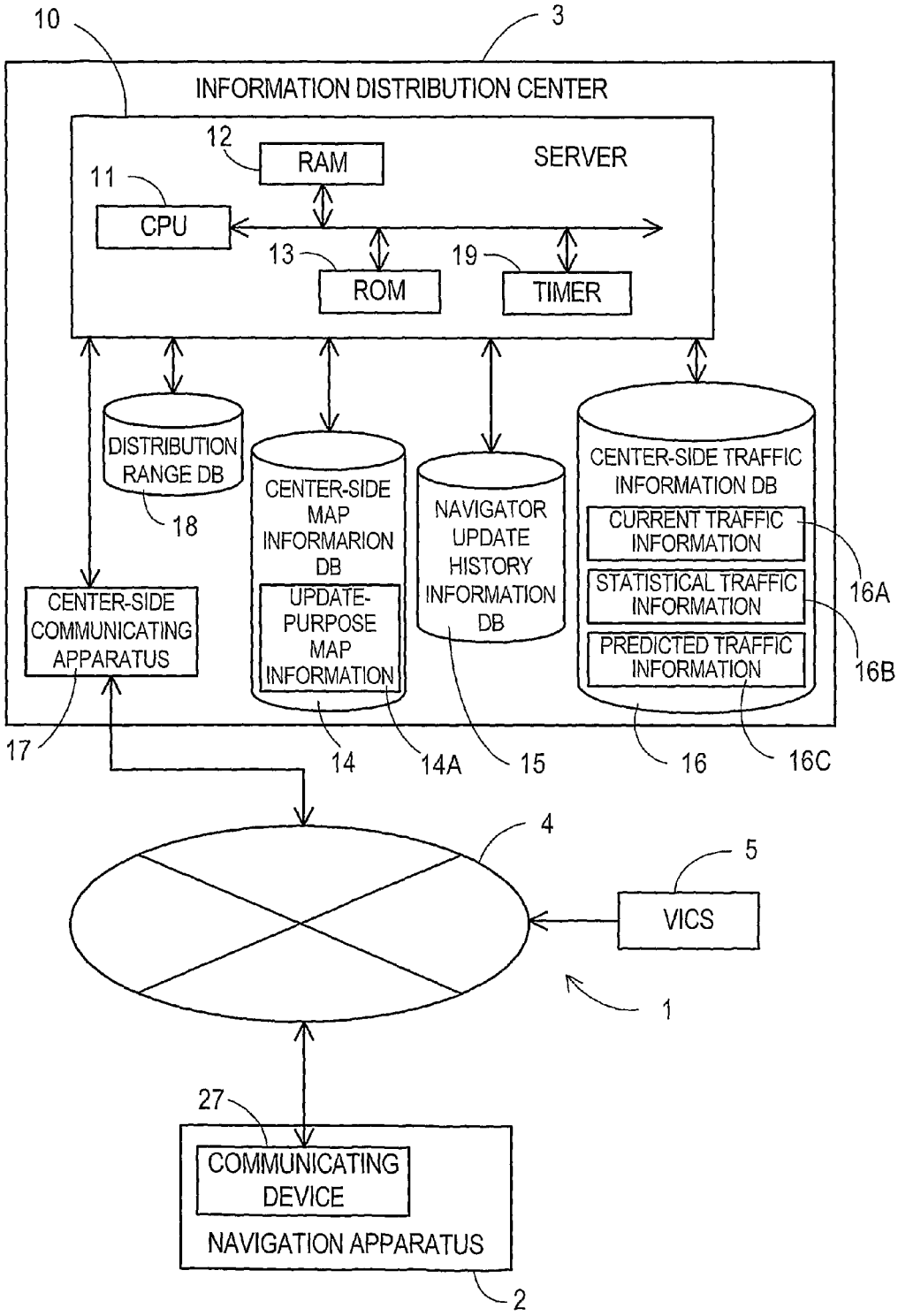
FIG. 1 is a block diagram that shows a navigation system according to an embodiment of the present invention.

A schematic configuration of a navigation system 1 according to the present embodiment will be explained with reference to FIG. 1. FIG. 1 is a block diagram that shows the navigation system 1 according to the present embodiment.

As shown in FIG. 1, the navigation system 1 according to the present embodiment is basically configured so as to include: a navigation apparatus 2; an information distribution center 3 as the traffic information distributing apparatus that distributes, to the navigation apparatus 2, update information used for updating map information as well as traffic information including congestion information (which will be explained later); and a network 4. The navigation apparatus 2 and the information distribution center 3 are configured so as to be able to transmit and receive various types of information to and from each other, via the network 4.

A Vehicle Information and Communication System (VICS: a registered trademark) 5 is connected to the network 4. The navigation apparatus 2 and the information distribution center 3 are configured so as to be able to receive, once in a predetermined period of time via the network 4, traffic information including information related to congestion of roads and traffic control information that have been generated by collecting information from traffic control systems such as the police and the Japan Highway Public Corporation. The traffic information is detailed information related to road traffic information such as, for example, road congestion information related to congestion of roads and traffic control information due to road constructions and building constructions.

The detailed information, if it is road congestion information, shows the following: a VICS link ID (explained later); the actual length of the congestion, the time required to drive through the congestion; the level of congestion (e.g., no congestion/crowded/congested); the speed of the vehicles in the congestion; the travel time; the traveling direction in the congested lane; and the time at which the congestion is expected to be over. The detailed information, if it is traffic control information, shows the following: a VICS link ID (explained later); the duration period of a road construction or a building construction; the type of traffic control indicating that, for example, the road is closed, one lane is alternately shared between two-way traffic, or the number of lanes is reduced; and the time period during which the traffic control is applied.

The configuration of the navigation apparatus 2 will be explained in detail later, with reference to FIG. 2.

As shown in FIG. 1, the information distribution center 3 includes: a server 10; a center-side map information database (hereinafter, the center-side map information DB) 14 that is connected to the server 10 and serves as a map information recording unit; a navigator update history information database (hereinafter, the navigator update history information DB) 15; a center-side traffic information database (hereinafter, the center-side traffic information DB) 16; a center-side communicating apparatus 17; and a distribution range database (hereinafter the distribution range DB) 18.

The server 10 includes: a CPU 11 that serves as a computing and controlling device that exercises the overall control of the server 10; internal storage devices such as a RAM 12 that is used as a working memory when the CPU 11 performs various types of computation processes and a ROM 13; and a timer 19 that measures time. It is acceptable to use an MPU instead of the CPU 11. The ROM 13 has recorded therein various types of control programs for performing a map information updating process to, according to a request from the navigation apparatus 2, extract update information from the center-side map information DB 14 and distribute the extracted update information to the navigation apparatus 2, so as to update a piece of map information corresponding to a predetermined area out of pieces of map information stored in the navigation apparatus 2, with a piece of map information of a new version.

The internal storage devices such as the ROM 13 also stores therein various types of control programs for performing a predicted traffic information distributing process (see FIG. 3) to generate current traffic information based on probe information collected from probe cars and traffic information collected from the Vehicle Information Communication System (VICS: a registered trademark) 5 and to distribute, according to a request from the navigation apparatus 2, the current traffic information via the network 4. Examples of the probe information include: the month, the day and the time, link information (e.g., a mesh ID, a link ID, the link length, whether there are traffic lights or not, the type of the road etc.), the traffic conditions (e.g., the travel time, the level of congestion, the speed etc.), the position of the vehicle, a mesh ID of the secondary mesh to which the vehicle position belongs, the operating state of the windshield wipers, the vehicle exterior/road surface temperature, the weather, ABS (Antilock Brake System) operation information, the road surface conditions, and the vehicle information (e.g., the type of the vehicle, the specifications and performance, the vehicle speed, the passengers, the allocation rate of the weight of the vehicle, and how a torque is applied).

The center-side map information DB 14 stores therein update-purpose map information 14A that is map information used as a base when the map information that has been generated in the information distribution center 3 and stored in the navigation apparatus 2 is to be updated, the update-purpose map information 14A being stored while being separated according to the version thereof. The center-side map information DB 14 further stores therein update information used for updating a part or the entirety of the map information currently stored in the navigation apparatus 2 with the update-purpose map information 14A. The version mentioned here is generation time information for identifying a time at which each piece of map information was generated. By referring to the version, it is possible to identify a time at which each piece of map information was generated.

Various types of information that are required in order for the navigation apparatus 2 to provide route guidance and display maps are recorded in the update-purpose map information 14A stored in the center-side map information DB 14. For example, the update-purpose map information 14A includes map display data used for displaying maps, intersection data related to intersections, node data related to node points, link data related to roads (i.e., road links) that are a type of facility, search data for searching for a route, shop data related to Points of Interest (POI) such as shops that are a type of facility, and retrieval data for retrieving a point of location.

In particular, the map display data is structured with units of quarters (dividing the length into halves), units of sixteenths (dividing the length into quarters), and units of sixty-fourths (dividing the length into eighths) obtained by dividing the secondary meshes each of which is approximately 10 kilometers squared. The units for different locations are set so that the data amount for each of the unit is substantially at the same level. The smallest unit, which has the size of one sixty-fourth of a secondary mesh, is an area of approximately 1.25 kilometers squared.

As the node data, data related to the following is recorded: the actual branching points of the roads (including intersections and T-intersections); the coordinates (i.e., the positions) of the node points that are set in each of the roads for every section having a predetermined distance according to the curvature radius thereof or the like; the node attribute that shows whether each node corresponds to an intersection or not; a connected link number list that is a list of link IDs used as identification numbers of the links that are connected to the nodes; an adjacent node number list that is a list of the node numbers of the nodes that are positioned adjacent to the nodes via links; and the height (i.e., the altitude) of the node points.

As the link data, data related to the following is recorded: With regard to road links, (hereinafter, simply referred to as links) that constitute roads, data expressing the width of the road to which the link belongs, the inclination, the cant, the bank, the road surface conditions, the number of lanes of the road, the locations at which the number of lanes is reduced, the locations at which the width of the road becomes smaller, and railroad crossings; With regard to corners, data expressing the curvature radius, the intersections, the T-intersections, the entrance and the exit of the corners; With regard to the road attribute, data expressing downhill roads and uphill roads; With regard to the types of the roads, data expressing general roads such as national roads, prefectural roads, and small streets as well as toll roads such as national expressways, urban expressways, ordinary toll roads, and toll bridges. In addition, with regard to the toll roads, data related to ramps at the entrance and the exit of each toll road and toll booths (i.e., interchanges) is recorded.

In the following description, national expressways, urban expressways, automobile-only roads, ordinary toll roads, and national routes identified with one-digit and two-digit numbers will be referred to as high-standard roads. National routes identified with three-digit numbers, major local roads, prefectural roads, roads belonging to cities, towns, or villages will be referred to as general roads. Also, streets that are narrower than the general roads and are seen in, for example, urban areas will be referred to as small streets.

As the search data, data that is used when a route to a specified destination is searched for or displayed is recorded. The search data includes cost data that is used for calculating a weight (hereinafter, referred to as a cost) for each of the nodes that is determined based on a right/left turn made when the vehicle passes the node, the distance of the links that constitute the road, the width of the road, and the type of the road, as well as route display data used for displaying a route selected in a route searching process on a map displayed on a liquid crystal display 25 (see FIG. 2) included in the navigation apparatus 2.

As the shop data, data related to the POIs in each location such as hotels, hospitals, gas stations, parking lots, and sightseeing facilities is recorded with the IDs that identify the POIs, respectively. The center-side map information DB 14 also records therein audio output data for outputting predetermined information through a speaker 26 (see FIG. 2) that is included in the navigation apparatus 2.

At a time when a request is made by the navigation apparatus 2, the information distribution center 3 updates the map information stored in the navigation apparatus 2 with one of the pieces, which is the newest version, of update-purpose map information 14A stored in the center-side map information DB 14. More specifically, in the navigation system 1 according to the present embodiment, when the navigation apparatus 2 has requested that a piece of update-purpose map information 14A should be distributed thereto, update information used for updating the stored map information with the one of the pieces of update-purpose map information 14A, which is the newest version, is distributed to the navigation apparatus 2, so that an updating process can be performed.

In order to transmit the update information to the navigation apparatus 2, it is acceptable to transmit the entire information of the one of the pieces of update-purpose map information 14A, which is the newest version, that includes new road information for identifying newly-built roads. Alternatively, it is acceptable to transmit minimum necessary information (e.g., only the information in an updated portion that includes the new road information for identifying the newly-built roads) for updating the map information currently stored in the navigation apparatus 2 with the one of the pieces of update-purpose map information 14A, which is the newest version.

The navigator update history information DB 15 stores therein information related to an update history indicating the updates that have so far been applied to the map information stored in the navigation apparatus 2, together with a navigator identifying ID that identifies the navigation apparatus 2. As the update history, data specifically showing which version of map information is used for each of the pieces of link data and the pieces of node data that constitute the map information is stored. Every time the map information stored in the navigation apparatus 2 is updated, the update history is re-written with new data.

The center-side traffic information DB 16 stores therein current traffic information 16A that is information related to current road congestion or the like and has been generated by collecting the probe information collected from the probe cars and traffic information received from the Vehicle Information Communication System (VICS: a registered trademark) 5. Examples of the probe information include: the month, the day and the time, link information (e.g., a mesh ID, a link ID, the link length, whether there are traffic lights or not, the type of the road etc.), the traffic conditions (e.g., the travel time, the level of congestion, the speed etc.), the position of the vehicle, a mesh ID of the secondary mesh to which the vehicle position belongs, the operating state of the windshield wipers, the vehicle exterior/road surface temperature, the weather, ABS (Antilock Brake System) operation information, the road surface conditions, and the vehicle information (e.g., the type of the vehicle, the specifications and performance, the vehicle speed, the passengers, the allocation rate of the weight of the vehicle, and how a torque is applied).

The center-side traffic information DB 16 also stores therein statistical traffic information 16B that has been generated based on traffic information from the past, including VICS signals received from the Vehicle Information Communication System (VICS: a registered trademark) 5 and the probe information collected from the probe cars.

The statistical traffic information 16B may include event schedule information such as locations, dates, and times of events including festivals, parades, and firework shows. The statistical traffic information 16B may also include statistical congestion information or congestion prediction information indicating that, for example, the roads near a station or a large shopping mall are congested every day during a specific time period of the day except on the weekends, or the roads near a swimming beach are congested during summer holidays.

The center-side traffic information DB 16 also stores therein, as explained later, predicted traffic information 16C that is congestion prediction information or the like and is predicted for once in a predetermined period of time in the future (e.g., once every 15 minutes, once every 30 minutes, or once every hour after the current time) with respect to the current congestion situations generated based on the current traffic information 16A and the statistical traffic information 166B (see the left side of FIG. 6).

At a time when a request is made by the navigation apparatus 2, the information distribution center 3 selects and distributes traffic information between intersections based on the current traffic information 16A, the statistical traffic information 166B, and the predicted traffic information 16C that is congestion prediction information or the like, each of which is stored in the center-side traffic information DB 16.

The traffic information received from the Vehicle Information and Communication System (VICS: a registered trademark) 5 includes a VICS link ID as well as the road type information, and information related to the position, the distance of the congested section, the travel time, and the level of congestion. The VICS link ID is an identification number that is assigned to each VICS link serving as a driving guidance link standardized while the road is divided into sections at predetermined intersections. The traffic information also includes information related to the coordinates of the starting point and the ending point of each of the VICS links and also a distance between the starting point and the ending point.

The roads (i.e., links) that are stored in the center-side map information DB 14 and the VICS links are not the same as each other (Generally speaking, roads (links) are more finely divided than VICS links are). Thus, a conversion table (i.e., a reference table) to convert between road link IDs and the VICS link IDs is provided, the road link IDs being assigned to the roads (i.e., links), respectively, as identification numbers. By referring to the conversion table, it is possible to identify, based on a VICS link ID, a road link ID that corresponds to the VICS link ID. With this arrangement, it is possible to transmit the traffic information after converting the VICS link IDs to road link IDs that are used in the navigation apparatus 2.

The distribution range DB 18 stores therein a plurality of distribution ranges that serve as predetermined ranges (e.g., each range has an area of 50 kilometers squared in which a vehicle position is located at the center thereof or a range having an area of 30 kilometers squared positioned in a forward direction of the vehicle position) that are used as transmission targets of the current traffic information 16A, the statistical traffic information 16B, and the predicted traffic information 16C, when any of these types of traffic information 16A, 16B, and 16C is distributed according to a request made by the navigation apparatus 2 (as explained later).

It is acceptable to have an arrangement in which the information distribution center 3 is run by any of the following: an individual, a corporation, an organization, a local government, and a government-related organization. The information distribution center 3 may be run by the Vehicle Information Communication System (VICS: a registered trademark) 5, as well.

As the network 4, it is possible to use a communication system of any communication network such as, for example, a LAN (Local Area Network), a WAN (Wide Area Network), an Intranet, a mobile phone line network, a telephone line network, a public communication line network, a dedicated communication line network, or the Internet. It is also possible to use a communication system that uses CS broadcast realized by broadcast satellites, BS broadcast, terrestrial digital television broadcast, or FM multiplex broadcast. Further, it is also possible to use a communication system in an Electronic Toll Collection (ETC) system used in Intelligent Transport Systems (ITS) or in a Dedicated Short Range Communication (DSRC) system.

Next, a schematic configuration of the navigation apparatus 2 that is included in the navigation system 1 according to the present embodiment will be explained, with reference to FIG. 2. FIG. 2 is a block diagram that shows the navigation apparatus 2 according to the present embodiment.

Figure 2:
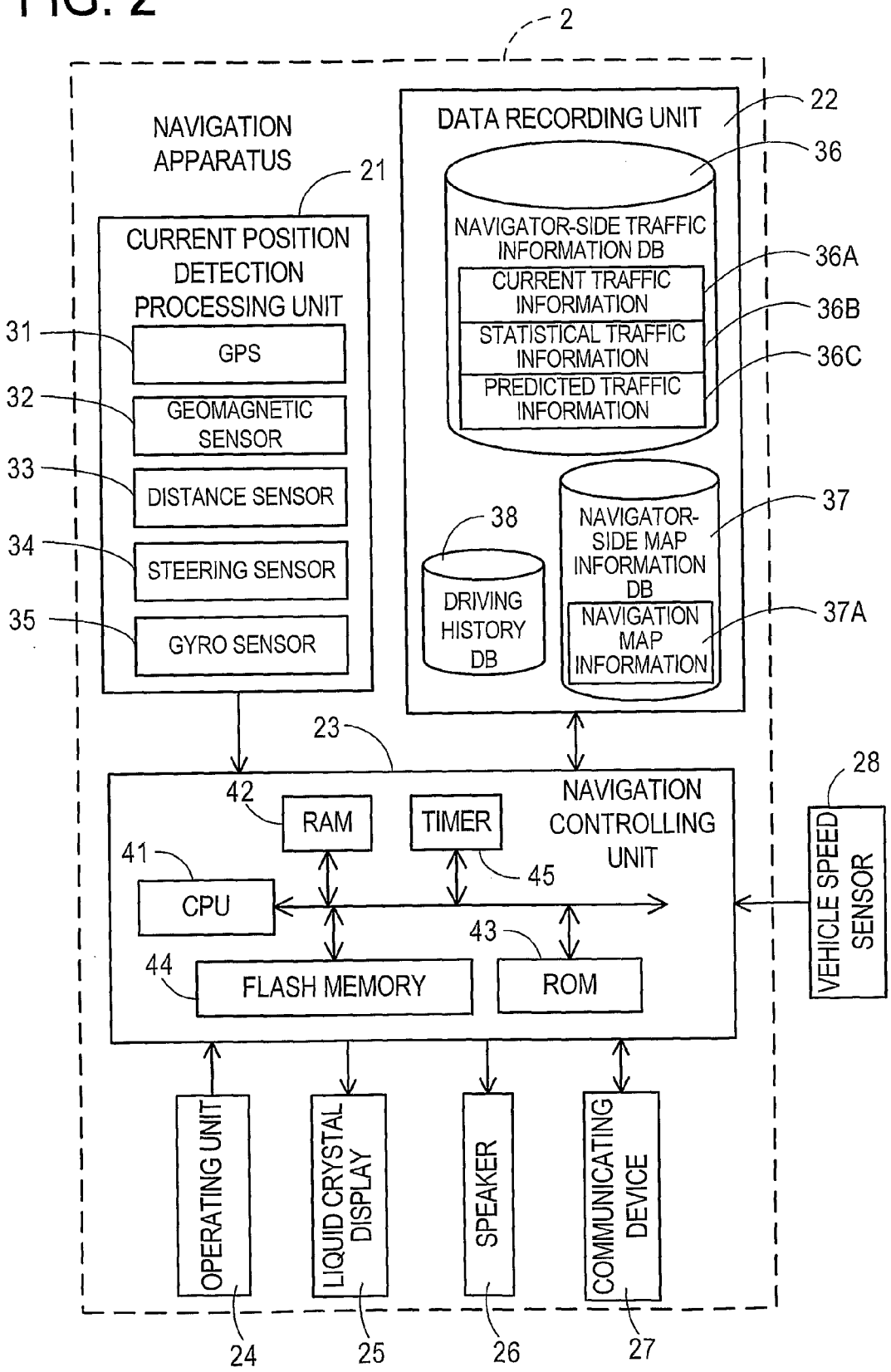
FIG. 2 is a block diagram that shows a navigation apparatus included in the navigation system.

As shown in FIG. 2, the navigation apparatus 2 according to the present embodiment includes a current position detection processing unit 21 that detects a current position of the vehicle in which the navigation apparatus 2 is installed; a data recording unit 22 that has recorded therein various types of data; a navigation controlling unit 23 that performs various types of computation processes, based on input information; an operating unit 24 that receives an operation from an operator; the liquid crystal display 25 that displays information such as maps to the operator; the speaker 26 that outputs audio guidance related to route guidance; and a communicating device 27 that performs communication with the Vehicle Information and Communication System (VICS: a registered trademark) 5, the information distribution center 3, or the like via, for example, a mobile phone line network. A vehicle speed sensor 28 that detects the driving speed of the vehicle is connected to the navigation controlling unit 23.

Next, the constituent elements of the navigation apparatus 2 will be explained. The current position detection processing unit 21 includes a GPS 31, a geomagnetic sensor 32, a distance sensor 33, a steering sensor 34, a gyro sensor 35 that serves as a direction detecting unit, and an altimeter (not shown in the drawing). The current position detection processing unit 21 is configured so as to be able to detect a current position of the vehicle, the direction in which the vehicle is oriented, the distance to a target object (for example, an intersection), and the like.

More specifically, the GPS 31 detects a current position of the vehicle on the earth and a current time by receiving a radiowave generated by an artificial satellite. The geomagnetic sensor 32 detects the direction in which the vehicle is oriented by measuring the terrestrial magnetism. The distance sensor 33 detects, for example, a distance between predetermined positions on a road. As the distance sensor 33, it is acceptable to use a sensor that measures the rotation speed of the wheels (not shown in the drawing) of the vehicle and detects a distance based on the measured rotation speed, or a sensor that measures the acceleration and detects a distance by performing the integration twice on the measured acceleration.

The steering sensor 34 detects a steering angle of the vehicle. As the steering sensor 34, it is acceptable to use, for example, an optical rotation sensor that is attached to a rotating portion of the steering wheel (not shown in the drawing), a rotation resistance sensor, or an angle sensor attached to the wheels.

The gyro sensor 35 detects the turning angle of the vehicle. As the gyro sensor 35, it is acceptable to use, for example, a gas rate gyro, a vibration gyro, or the like. By performing the integration on the turning angle detected by the gyro sensor 35, it is possible to detect the direction in which the vehicle is oriented.

The data recording unit 22 includes: a hard disk (not shown in the drawing) that serves as an external storage device and a storage medium; databases that are stored in the hard disk, the databases namely being a navigator-side traffic information database (hereinafter, the navigator-side traffic information DB) 36, a navigator-side map information database (hereinafter, the navigator-side map information DB) 37, and a driving history database (hereinafter, the driving history DB) 38; and a recording head (not shown in the drawing) that serves as a driver to read a predetermined program and the like and also to write predetermined data to the hard disk.

In the present embodiment, the hard disk is used as the external storage device and the storage medium included in the data recording unit 22; however, instead of the hard disk, it is acceptable to use a magnetic disc such as a flexible disc as the external storage device. Alternatively, it is acceptable to use, as the external storage device, a memory card, a magnetic tape, a magnetic drum, a CD, an MD, a DVD, an optical disc, an MO, an IC card, an optical card, or the like.

The navigator-side traffic information DB 36 stores therein current traffic information 36A generated based on traffic information that has been received from the information distribution center 3 or the Vehicle Information and Communication System (VICS) 5, the traffic information including road congestion information related to the current congestion conditions of the roads such as the actual length of the congestion, the required travel time, the cause of the congestion, and the time at which the congestion is expected to be over as well as traffic control information due to road constructions, building constructions, and the like. Statistical traffic information 36B stored in the navigator-side traffic information DB 36 includes the aforementioned statistical traffic information 16B that has been distributed from the information distribution center 3 via the communicating device 27.

The contents of the statistical traffic information 16B included in the statistical traffic information 36B is updated by downloading the update information that has been distributed from the information distribution center 3 via the communicating device 27. It is acceptable to configure the navigation apparatus 2 so as to have an arrangement in which the aforementioned statistical traffic information 16B supplied on a CD-ROM or the like is stored into the statistical traffic information 36B, so that the statistical traffic information 36B is updated based on a driving history, once in a predetermined period of time (for example, once a week or once every three months).

The statistical traffic information 36B may also include event schedule information such as locations, dates, and times of events including festivals, parades, and firework shows. In addition, the statistical traffic information 36B may also include statistical congestion information or congestion prediction information indicating that, for example, the roads near a station or a large shopping mall are congested every day during a specific time period of the day except on the weekends, or the roads near a swimming beach are congested during summer holidays.

Further, the navigator-side traffic information DB 36 stores therein the predicted traffic information 16C described above that has been distributed from the information distribution center 3 via the communicating device 27. The contents of the predicted traffic information 16C included in the predicted traffic information 36C is updated by downloading the update information that has been distributed from the information distribution center 3 via the communicating device 27. It is acceptable to configure the navigation apparatus 2 so as to have an arrangement in which the aforementioned predicted traffic information 16C supplied on a CD-ROM or the like is stored into the predicted traffic information 36C, so that the predicted traffic information 36C is updated based on the current traffic information 36A and the statistical traffic information 36B, once in a predetermined period of time (for example, once a week or once every three months).

The navigator-side map information DB 37 stores therein navigation map information 37A that is used in driving guidance and route searches performed by the navigation apparatus 2 and is also a target of an update performed by the information distribution center 3. Like the update-purpose map information 14A, the navigation map information 37A includes various types of information that are required in order to provide route guidance and display maps. The navigation map information 37A includes, for example, new road information for identifying newly-built roads, map display data for displaying maps, intersection data related to intersections, node data related to node points, link data related to roads (i.e., links) that are a type of facility, search data for searching for a route, shop data related to Points of Interest (POI) such as shops that are a type of facility, and retrieval data for retrieving a point of location.

The details of the various types of data have already been explained above. Thus, detailed explanation thereof will be omitted. The contents of the navigator-side map information DB 37 is updated by downloading the update information that has been distributed from the information distribution center 3 via the communicating device 27.

Every time the vehicle is driven on a link, the driving history DB 38 sequentially stores therein, a driving history. Examples of the driving history include: the month, the day and the time, link information (e.g., a mesh ID, a link ID, the link length, whether there are traffic lights or not, the type of the road etc.), the traffic conditions (e.g., the travel time, the level of congestion, the speed etc.), the position of the vehicle, a mesh ID of the secondary mesh to which the vehicle position belongs, the operating state of the windshield wipers, the vehicle exterior/road surface temperature, the weather, ABS (Antilock Brake System) operation information, the road surface conditions, and the vehicle information (e.g., the type of the vehicle, the specifications and performance, the vehicle speed, the passengers, the allocation rate of the weight of the vehicle, and how a torque is applied).

Also, as shown in FIG. 2, the navigation controlling unit 23 included in the navigation apparatus 2 includes: a CPU 41 that serves as a computing and controlling device that exercises the overall control of the navigation apparatus 2; internal storage devices such as a RAM 42 that is used as a working memory when the CPU 41 performs various types of computation processes and that stores therein, for example, route data after a route has been found in a search and the traffic information received from the information distribution center 3, a ROM 43 that stores therein, in addition to programs used for exercising control, a predicted traffic information obtaining process program (see FIG. 3) used for requesting the information distribution center 3 that predicted traffic information should be distributed, and a flash memory 44 that stores therein a program that has been read from the ROM 43; as well as a timer 45 that measures time.

As each of the RAM 42, the ROM 43, and the flash memory 44, it is acceptable to use a semiconductor memory, a magnetic core, or the like. Also, as the computing and controlling device, it is acceptable to use an MPU or the like, instead of the CPU 41.

According to the present embodiment, various types of programs are stored in the ROM 43, and also various types of data are stored in the data recording unit 22; however, it is also acceptable to have an arrangement in which the programs and the data are read from the same external storage device such as a memory card and written to the flash memory 44. Further, by replacing the memory card or the like, it is possible to update the programs and the data.

Further, peripheral devices (actuators) for the operating unit 24, the liquid crystal display 25, the speaker 26, and the communicating device 27 are electrically connected to the navigation controlling unit 23.

The operating unit 24 is operated, for example, when a starting point that serves as a guidance starting location and a destination that serves as a guidance terminal location are input by correcting the current location indicated when the vehicle starts being driven or when information related to facilities is retrieved. The operating unit 24 includes various types of keys and a plurality of operation switches. According to each of switch signals that are output when the switches are pushed or the like, the navigation controlling unit 23 controls so that a corresponding one of various types of operations is performed.

As the operating unit 24, it is acceptable to use a keyboard, a mouse, a barcode reader, a remote control device for remote-control operations; a joy stick, a light pen, a stylus pen, or the like. Further, it is acceptable to configure the operating unit 24 with a touch panel provided on the front surface of the liquid crystal display 25.

The liquid crystal display 25 is operable to display a route guidance screen on which a map based on the navigation map information 37A is displayed so that traffic information for each of the links can be displayed. The liquid crystal display 25 is also operable to display an operation guide, guidance related to operation menus and keys, a guiding route to guide the vehicle from a current location to a destination, guidance information along the guiding route, the traffic information, news, weather forecasts, the time, electronic mail, TV programs, and the like. Instead of the liquid crystal display 25, it is acceptable to use a CRT display, a plasma display, or the like. It is also acceptable to use a hologram device that projects a hologram image onto the windshield glass of the vehicle.

According to an instruction from the navigation controlling unit 23, the speaker 26 outputs, for example, audio guidance to guide the vehicle to drive along the guiding route. The audio guidance that is provided as a guide may be, for example, "Go 200 meters and turn right at intersection X", "National Route No. X ahead is congested." The audio output from the speaker 26 may be a synthesized audio, various types of sound effects, or various types of other guidance information that has been recorded on a tape or in a memory, in advance.

The communicating device 27 is a communicating unit that performs communication with the information distribution center 3 via a mobile phone line network, or the like. The communicating device 27 also transmits and receives a piece of update map information, which is the newest version as well as the current traffic information to and from the information distribution center 3. In addition, the communicating device 27 receives, not only information from the information distribution center 3, but also traffic information transmitted from the Vehicle Information Communication System (VICS) 5 or the like that includes congestion information, traffic control information, parking lot information, traffic accident information, and information about how crowded service areas are.

Next, the predicted traffic information obtaining process that is performed by the CPU 41 included in the navigation apparatus 2 and the predicted traffic information distributing process that is performed by the CPU 11 provided in the information distribution center 3 to distribute the predicted traffic information to the navigation apparatus 2, in the navigation system 1 configured as described above, will be explained with reference to FIGS. 3 to 6.

Figure 3:
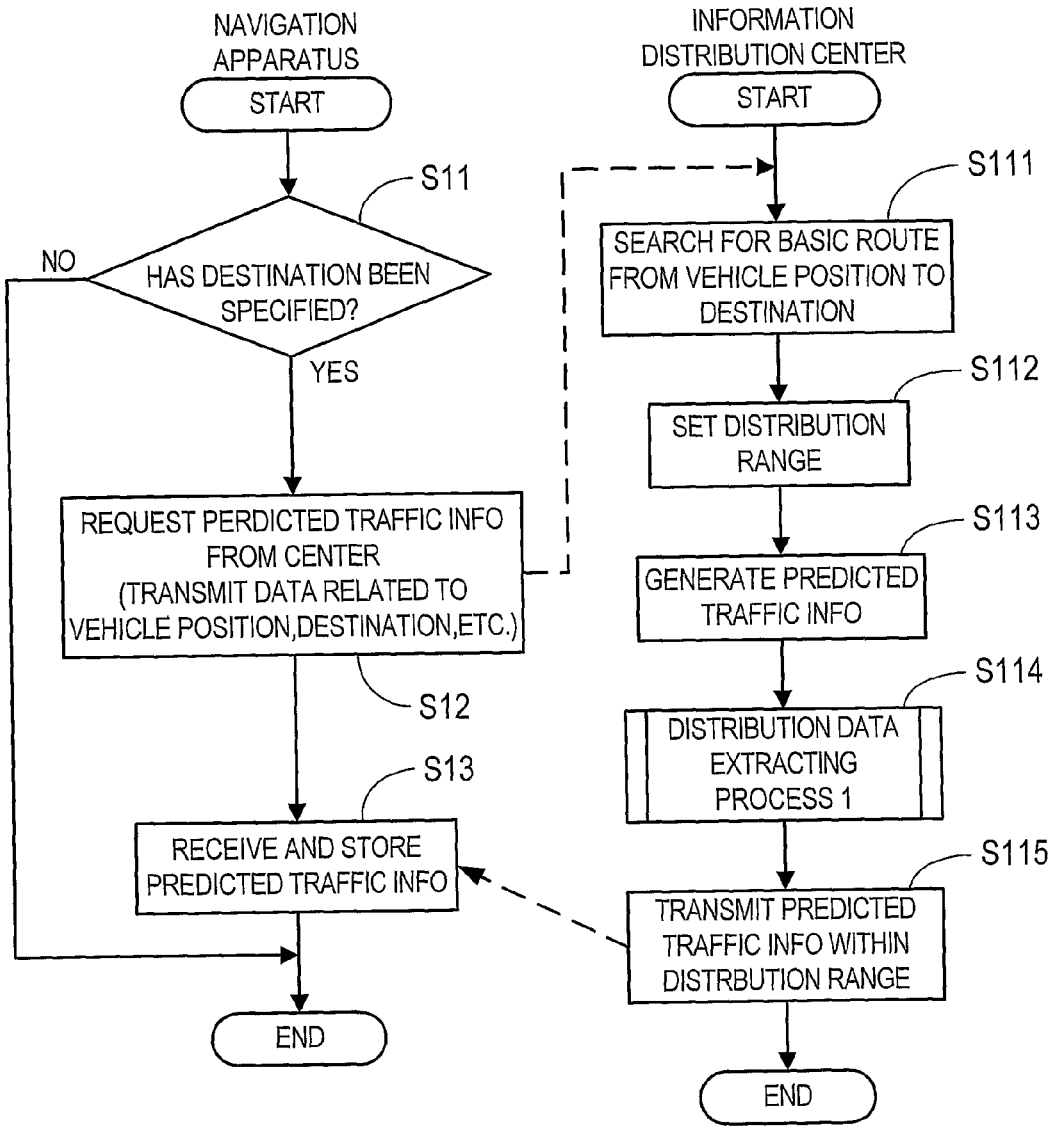
FIG. 3 is a main flowchart that shows a predicted traffic information obtaining process that is performed by a CPU included in the navigation apparatus and a predicted traffic information distributing process that is performed by a CPU provided in an information distribution center to distribute predicted traffic information to the navigation apparatus.
Figure 4:
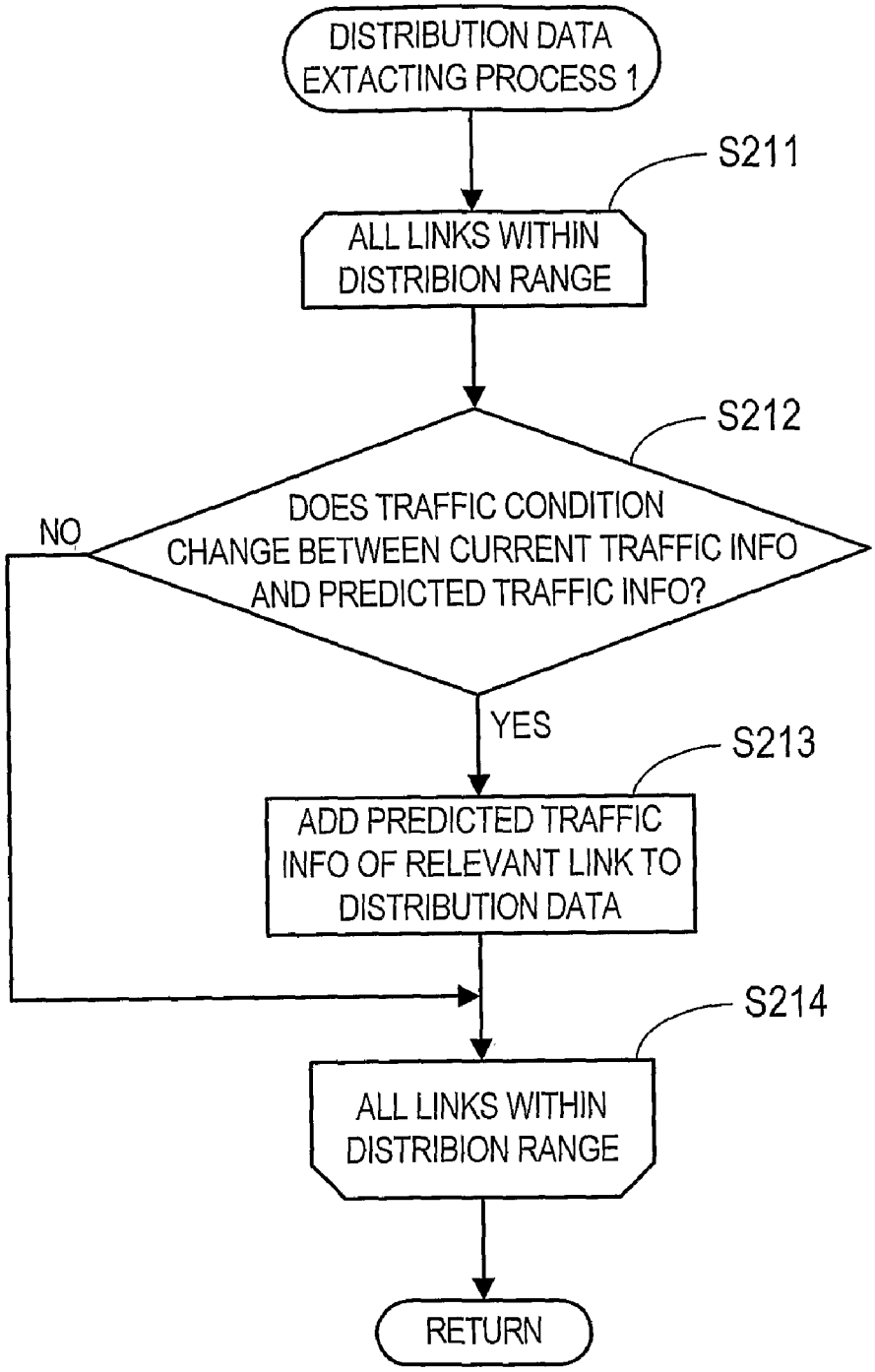
FIG. 4 is a sub-flowchart that shows a sub-process of a distribution data extracting process 1 shown in FIG. 3.
Figure 5:
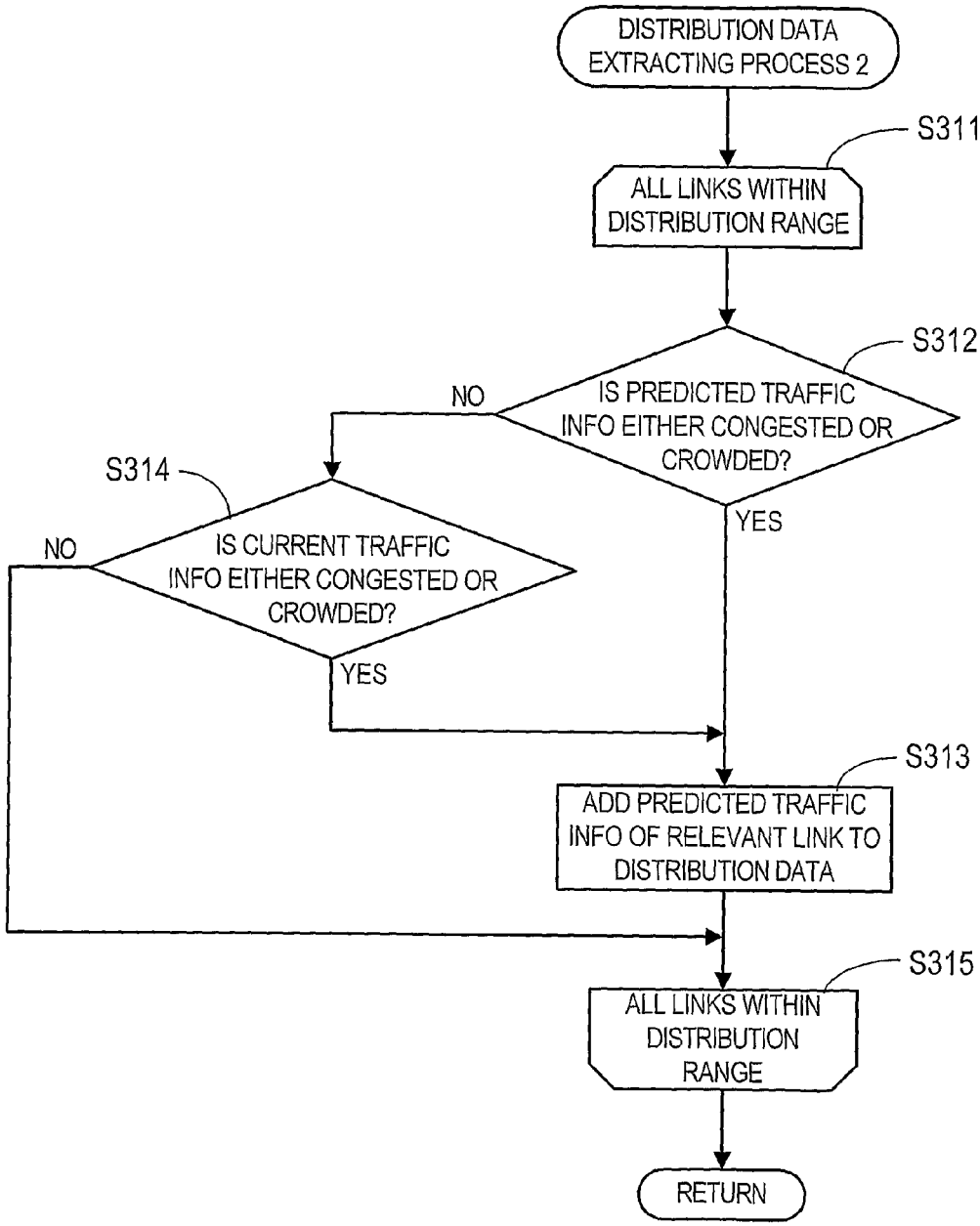
FIG. 5 is a sub-flowchart that shows a sub-process of a distribution data extracting process 2 to extract predicted traffic information concerning the presence or absence of congestion as a specific example of the distribution data extracting process 1 shown in FIG. 3.

FIG. 3 is a main flowchart that shows the predicted traffic information obtaining process that is performed by the CPU 41 included in the navigation apparatus 2 and the predicted traffic information distributing process that is performed by the CPU 11 provided in the information distribution center 3 to distribute the predicted traffic information to the navigation apparatus 2. FIG. 4 is a sub-flowchart that shows a sub-process of a distribution data extracting process 1 shown in FIG. 3. FIG. 5 is a sub-flowchart that shows a sub-process of a distribution data extracting process 2 to extract the predicted traffic information 16C concerning the presence or the absence of congestion as a specific example of the distribution data extracting process 1 shown in FIG. 3.

First, the predicted traffic information obtaining process that is performed by the CPU 41 included in the navigation apparatus 2 will be explained, with reference to FIG. 3. The program shown at S11 through S13 in the flowchart in FIG. 3 is stored in the RAM 42 or the ROM 43 included in the navigation apparatus 2 and is executed by the CPU 41.

As shown in FIG. 3, at first, at step (hereinafter, simply expressed as "S") 11, the CPU 41 performs a judging process to judge whether or not a destination has been specified through an input operation or the like performed on the operating unit 24 such as a touch panel or an operation switch. In a case where no destination has been specified (S11: NO), the CPU 41 ends the process.

On the contrary, in a case where it is judged that a destination has been input (S11: YES), the CPU 41 temporarily stores coordinates of the destination or the like into the RAM 42 and then proceeds to the process at S12.

Subsequently, at S12, the CPU 41 transmits, to the information distribution center 3, a request command for requesting predicted traffic information as well as a navigator identifying ID, coordinate data of a current position of the vehicle (hereinafter, simply referred to as the position of the vehicle or the vehicle position), coordinate data of the destination, a route search criterion, the version information of the navigation map information 37A, and the like.

After that, at S13, the CPU 41 receives, from the information distribution center 3, the predicted traffic information 16C and the like that includes the congestion prediction information and the traffic control prediction information and the like, stores the received predicted traffic information 16C and the like into the predicted traffic information 36C and the like, and ends this process.

Next, the predicted traffic information distributing process performed by the CPU 11 provided in the information distribution center 3 will be explained, with reference to FIG. 3. The program shown at S111 through S115 in the flowchart in FIG. 3 is stored in the RAM 12 or the ROM 13 included in the information distribution center 3 and is executed by the CPU 11.

First, at S111, the CPU 11 receives the request command for requesting the predicted traffic information that has been transmitted from the navigation apparatus 2 at S12 as explained above, as well as the vehicle information such as the navigator identifying ID, the coordinate data of the position of the vehicle, the coordinate data of the destination, the route search criterion, the version information of the navigation map information 37A. The CPU 11 then stores the received vehicle information into the RAM 12. The CPU 11 searches for a basic route to get to the destination according to the received search criterion, based on the update-purpose map information 14A that corresponds to the version information of the navigation map information 37A stored in the center-side map information DB 14 and stores the basic route found in the search into the RAM 12.

At S112, the CPU 11 reads a distribution range that serves as a transmission target of the traffic information 16A, 16B, and 16C, out of the distribution range DB 18 and stores the read distribution range into the RAM 12.

For example, in a case where the distance from the vehicle position to the destination is equal to or longer than 100 kilometers, a range having an area of 50 kilometers squared in which the vehicle position is located at the center thereof, a range having an area of 30 kilometers squared positioned in a forward direction of the vehicle position, or the like is read from the distribution range DB 18 and is stored into the RAM 12 as the distribution range. In a case where the distance from the vehicle position to the destination is shorter than 50 kilometers, a range having an area of 30 kilometers squared in which the vehicle position is located at the center thereof, a range having an area of 15 kilometers squared positioned in a forward direction of the vehicle position, or the like is read from the distribution range DB 18 and is stored in the RAM 12 as the distribution range.

At 113, the CPU 11, based on the current traffic information 16A and the statistical traffic information 16B according to the distribution range set in S112 as explained above, generates the predicted traffic information 16C within the distribution range, and stores the generated predicted traffic information 16C in the center-side traffic information DB 16.

At S114, the CPU 11 performs the sub-process of the distribution data extracting process 1.

The sub-process of the distribution data extracting process 1 will be described with reference to FIG. 4.

As shown in FIG. 4, at S211, the CPU 11 extracts all the links of each of the roads within the distribution range specified at S112 as explained above, and stores the extracted links in the RAM 12 in sequence.

Next, at S212, the CPU 11 reads out from the center-side traffic information DB 16, the current traffic information 16A and the predicted traffic information 16C associated with the first link stored in the RAM 12 at S211, and performs the judging process to judge whether or not the traffic condition changes between the current traffic information 16A and the predicted traffic information 16C.

In a case where the traffic condition does not change between the current traffic information 16A and the predicted traffic information 16C associated with the first link (S212: NO), the CPU 11 proceeds to the process at S214.

On the contrary, in a case where the traffic condition changes between the current traffic information 16A and the predicted traffic information 16C associated with the first link (S212: YES), the CPU 11 proceeds to the process at S213. At S213, the CPU 11 stores the predicted traffic information 16C associated with the relevant link in the RAM 12 as the predicted traffic information 16C to be distributed to the navigation apparatus 2, together with the link ID identifying this link, and then proceeds to the process at S214.

Next, at S214, the CPU 11 judges whether or not the processes of S212 through S213 are performed with respect to all the links extracted at S211. In a case where it is judged that the processes of S212 through S213 are not performed with respect to all the links, the CPU 11 loops the next link, reads the current traffic information 16A and the predicted traffic information 16C associated with the next link from the center-side traffic information DB 16, and proceeds to the process at S212.

On the contrary, at S214, in a case where the CPU 11 judges that the processes of S212 through S213 are performed with respect to all the links extracted at S211, the loop is terminated to end the relevant sub-process, returns to the main flowchart so as to proceed to the process at S115.

As shown in FIG. 3, at S115, the CPU 11 reads, out from the RAM 12, each of the predicted traffic information 16C to be distributed to the navigation apparatus 2 and the link ID corresponding to each of the predicted traffic information 16C, distributes the read predicted traffic information 16C and link ID to the navigation apparatus 2 that corresponds to the navigator identifying ID received at S111 as explained above, and ends the process.

As a modification of the distribution data extracting process 1 performed at S114, the distribution data extracting process 2 extracting the predicted traffic information 16C concerning the traffic condition relating to the presence or the absence of road congestion will be described with reference to FIG. 5.

As shown in FIG. 5, at S311, the CPU 11 extracts all the links of each of the roads within the distribution range specified at S112 as explained above, and stores the extracted links in the RAM 12 in sequence.

Next, at S312, the CPU 11 reads the predicted traffic information 16C associated with the first link stored in the RAM 12 at S311 out from the center-side traffic information DB 16. Then the CPU 11 performs a judging process to judge whether or not the read predicted traffic information 16C is either congested road information indicating the presence of congestion or the crowded road information indicating the presence of crowd. In other words, the CPU 11 judges the whether or not the degree of congestion (e.g., no congestion in a case where the vehicle speed at the link is 20 kilometers per hour or more, crowded in a case where the vehicle speed is 10 kilometers per hour or more and less than 20 kilometers per hour, congested in a case where the vehicle speed is less than 10 kilometers per hour) of the links is either congested or crowded.

When the degree of congestion of the congestion prediction information of the predicted traffic information 16C associated with the first link is either congested or crowded (S312: YES), the CPU 11 proceeds to the process at S313. At S313, the CPU 11 stores, in the RAM 12, the predicted traffic information 16C associated with the relevant link as the predicted traffic information 16C to be distributed to the navigation apparatus 2, together with the link ID identifying this link, and then proceeds to the process at S315.

Here, the reason of storing, in the RAM 12, the predicted traffic information 16C associated with the relevant link as the predicted traffic information 16C to be distributed to the navigation apparatus 2, together with the link ID identifying this link, in a case where the degree of congestion of the congestion prediction information of the predicted traffic information 16C associated with the first link is either congested or crowded, is because even when the degree of congestion remains to be congested or crowded, the traffic condition of traveling time or the like may differ.

At S312, in a case where the degree of congestion of the congestion prediction information of the predicted traffic information 16C associated with the first link is neither congested nor crowded (S312: NO), the CPU 11 proceeds to the process at S314. At S314, the CPU 11 reads the current traffic information 16A associated with the first link stored in the RAM 12 at S311 as explained above out from the center-side traffic information DB 16. Then the CPU 11 performs the judging process to judge whether or not the current traffic information 16A is either the congested road information indicating the presence of congestion or the crowded road information indicating the presence of crowd. In other words, the CPU 11 judges the whether or not the degree of congestion of the link is either congested or crowded.

When the degree of congestion of the congestion prediction information of the current traffic information 16A associated with the first link is neither congested nor crowded (S314: NO), the traffic condition of the current traffic information 16A and the predicted traffic information 16C associated with the first link does not change, the CPU 11 proceeds to the process at S315.

When the degree of congestion of the congestion prediction information of the predicted traffic information 16C associated with the first link is either congested or crowded (S314: YES), the traffic condition changes between the current traffic information 16A and the predicted traffic information 16C associated with the first link changes, therefore the CPU 11 proceeds to the process at S313. At S313, the CPU 11 stores, in the RAM 12, the predicted traffic information 16C associated with the relevant link as the predicted traffic information 16C to be distributed to the navigation apparatus 2, together with the link ID identifying this link, and then proceeds to the process at S 315.

Next, at S315, the CPU 11 performs a judging process to judge whether or not the processes of S312 through S314 are performed with respect to all the links extracted at S 311. In a case where it is judged that the processes of S312 through S314 are not performed with respect to all the links, the CPU 11 loops the next link, reads the predicted traffic information 16C associated with the next link from the center-side traffic information DB 16, and proceeds to the process at S312.

On the contrary, at S315, in a case where the CPU 11 judges that the processes of S312 through S314 are performed with respect to all the links extracted at S311, the loop is terminated to end the relevant sub-process, and returns to the main flowchart to proceed to the process at S115.

One example of the predicted traffic information to be distributed to the navigation apparatus 2, in a case where the CPU 11 provided in the information distribution center 3 performs the distribution data extracting process 2 will be described with reference to FIG. 6.

Figure 6:
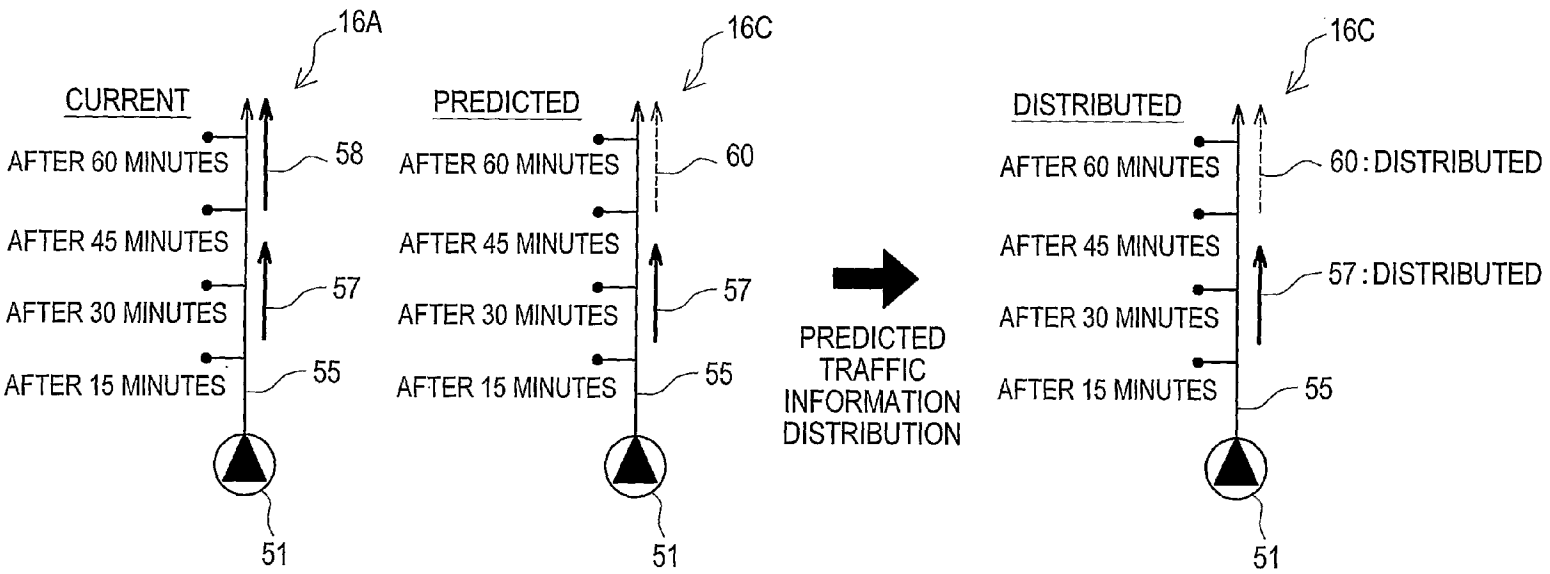
FIG. 6 is a view that shows an example of predicted traffic information generated by current traffic information and predicted traffic information to be distributed to the navigation apparatus in a case where the CPU of the information distribution center performs the distribution data extracting process 2.

FIG. 6 is a view that shows an example of the predicted traffic information generated by the current traffic information and the predicted traffic information to be distributed to the navigation apparatus 2 in a case where the CPU 11 provided in the information distribution center 3 performs the distribution data extracting process 2.

As shown on the left side of FIG. 6, on a road 55 within the distribution range specified at S112 as explained above, in the current traffic information 16A according to this road 55, at a location in which the vehicle arrives after approximately 18 minutes from the vehicle position shown by a vehicle position mark 51, and at a location in which the vehicle arrives after approximately 45 minutes from the vehicle position shown by the vehicle position mark 51, congested road information 57 and 58 indicating that the degree of congestion is congested, that is, indicating that the congestion is presence, are stored respectively. Each of the congested road information 57 and 58 includes the actual length of the congestion, the time required to drive through the congestion, the degree of congestion, the speed of the vehicles in the congestion, the traveling direction in the congested lane, the time at which the congestion is expected to be over, or the like.

Also, as shown on the left side of FIG. 6, in the predicted traffic information 16C according to the road 55, at a location in which the vehicle arrives after approximately 18 minutes from the vehicle position shown by the vehicle position mark 51, the congested road information 57 indicating that the degree of congestion is congested, that is, indicating that the congestion is presence, is stored. On the contrary, at a location in which the vehicle arrives after approximately 45 minutes from the vehicle position shown by the vehicle position mark 51, no-congestion road information 60 indicating that the degree of congestion is no congestion in which the congestion is released, that is, indicating that the congestion is absent, is stored.

Accordingly, as shown on the right side of FIG. 6, in a case where the above-described distribution data extracting process 2 is performed, the CPU 11 stores the congested road information 57 indicating that the degree of congestion is congested to be stored in the predicted traffic information 16C, in the RAM 12 as the predicted traffic information 16C to be distributed to the navigation apparatus 2 (S312: YES through S313 through S315). Thereby, the congested road information 57 is distributed to the navigation apparatus 2.

On the contrary, as shown on the left side of FIG. 6, no-congestion road information 60 indicating that the congestion is released and is absence to be stored to the predicted traffic information 16C, is not stored in the current traffic information 16A. Accordingly, since the traffic condition differs between the current traffic information 16A and the predicted traffic information 16C, the CPU 11 stores the no-congestion road information 60 in the RAM 12 as the predicted traffic information 16C to be distributed to the navigation apparatus 2, together with the link ID of the link corresponding to the no-congestion road information 60 (S314: YES through S313 through S315).

Next, the CPU 11 distributes the congested road information 57 indicating that the degree of congestion is congested and the no-congestion information 60 stored in the RAM 12, and the link ID of each link corresponding to the congested road information 57 and the no-congestion road information 60 to the navigation apparatus 2 as the predicted traffic information 16C (S115).

Accordingly, in a case where the congested road information 57, the no-congestion road information 60 and the link ID of each link corresponding to the congested road information 57 and the no-congestion road information 60 are received as the predicted traffic information 16C, the CPU 41 of the navigation apparatus 2 stores the congested road information 57, the no-congestion road information 60 and the link ID of each link corresponding to the congested road information 57 and the no-congestion road information 60 in the navigator-side traffic information DB 36 as the predicted traffic information 36C (S13). Accordingly, it is possible for the CPU 41 to search the route based on the traffic information 36A, 36B, and 36C, without avoiding the location, which the vehicle arrives approximately after 45 minutes from the vehicle position of the road 55, as the location with no congestion.

The route searching performed by the CPU 41 of the navigation apparatus 2 will be described below. The CPU 41 specifies the predicted traffic information 36C as the cost (weight), with respect to the road that the predicted traffic information 36C is presence. Also, the CPU 41 specifies the current traffic information 36A as the cost (weight), with respect to the road that the predicted traffic information 36C is absence. Further, the CPU 41 specifies the statistical traffic information 36B as the cost (weight), with respect to the road that the current traffic information 36A is also absence. Thus, the cost (weight) with respect to each road is specified, and searches a route of lowest cost (weight) to the destination, or a route avoiding the road of high cost (weight).

As explained in detail above, in the navigation system 1 according to the present embodiment, in a case where the CPU 11 provided in the information distribution center 3 receives the request command for requesting the predicted traffic information that has been transmitted from the navigation apparatus 2, as well as the vehicle information such as the navigator identifying ID, the coordinate data of the position of the vehicle, the coordinate data of the destination, the route search criterion, the version information of the navigation map information 37A, the CPU 11 searches the basic route based on the update-purpose map information 14A, and sets the distribution range that serves as a transmission target of the traffic information 16A, 16B and 16C (S111 through S112).

The CPU 11 generates the predicted traffic information 16C of the congestion prediction information or the like, based on the current traffic information 16A and the statistical traffic information 16B according to the distribution range (S113). Then, the CPU 11 extracts the predicted traffic information 16C of each link having a difference in the generated predicted traffic information 16C and the current traffic information 16A, and distributes the extracted predicted traffic information 16C to the navigation apparatus 2 together with the link ID of the corresponding links.

As a result, the CPU 11 provided in the information distribution center 3 distributes the predicted traffic information 16C different from the current traffic information 16A within the distribution range to the navigation apparatus 2. Thus, it is possible to reduce the communication information to keep the communication cost at a low level. Also, the CPU 11 provided in the information distribution center 3 extracts all of the predicted traffic information 16C different from the current traffic information 16A with respect the each link, and distributes the information to the navigation apparatus 2. Thus, it is possible to accurately distribute adequate amount of the predicted traffic information 16C as needed without distributing the predicted traffic information 16C having traffic condition that is not different from the current traffic information 36A already stored in the navigation apparatus 2. Eventually, it is possible for the CPU 41 of the navigation apparatus 2 to perform route searching with higher accuracy based on the accurate predicted traffic information 36C.

The CPU 11 provided in the information distribution center 3, in a case where the current traffic information 16A according to the link within the distribution range is the congested road information indicating that the congestion is presence, and the predicted traffic information 16C associated with the relevant link is the no-congestion road information indicating that the congestion is absence, the traffic condition changes between the current traffic information 16A and the predicted traffic information 16C associated with the link. Accordingly, the CPU 11 extracts the predicted traffic information 16C associated with the relevant link as the predicted traffic information 16C to be distributed to the navigation apparatus 2 (S311 through S315).

Accordingly, it is possible for the CPU 11 provided in the information distribution center 3 to accurately distribute the predicted no-congestion road information even when the amount of communication information distributed to the navigation apparatus 2 is reduced to keep the communication cost at a low level. Thereby, the CPU 41 of the navigation apparatus 2 searches the route without missing any links included in the no-congestion road information.

The present invention is not limited to the embodiment described above, and various improvements and modifications may naturally be made within the spirit and scope of the present invention.

The invention claimed is:

1. A traffic information distributing apparatus that distributes traffic information, comprising:

a vehicle information receiving unit that receives vehicle information from a navigation apparatus installed in a vehicle;

a current traffic information obtaining unit that obtains current traffic information which includes congested road information that indicates the presence of congestion and no-congestion road information that indicates the absence of congestion;

a predicted traffic information generating unit that generates, based on the vehicle information, predicted traffic information according to the time the vehicle arrives at each road along a route to a destination, the predicted traffic information including the congested road information that indicates the presence of congestion and the no-congestion road information that indicates the absence of congestion;

a predicted traffic information extracting unit that determines whether or not the predicted traffic information for a road is different from the current traffic information for the road, that extracts the predicted traffic information for the road if determined to be different from the current traffic information for the road, and that does not extract the predicted traffic information if both the predicted traffic information and the current traffic information are the no-congestion road information; and a traffic information distribution controlling unit that controls distribution of the predicted traffic information, extracted by the predicted traffic information extracting unit, to the navigation apparatus.

2. The traffic information distributing apparatus according to claim 1, further comprising:

a distribution range setting unit that sets a distribution range serving as a transmission target of the traffic information based on the vehicle information; wherein the predicted traffic information generating unit generates the predicted traffic information according to the distribution range.

3. The traffic information distributing apparatus according to claim 1, wherein:

in a case where the current traffic information is the congested road information and the predicted traffic information is the congested road information, the predicted traffic information extracting unit extracts the predicted traffic information.

4. The traffic information distributing apparatus according to claim 1, wherein:

in a case where the current traffic information is the congested road information and the predicted traffic information is the congested road information, the predicted traffic information extracting unit does not extract the predicted traffic information.

5. A traffic information distributing method executed at a traffic distribution center for distributing traffic information to a vehicle, from the traffic distribution center which is remote from the vehicle, comprising the steps of:

receiving vehicle information in a communication unit in the traffic distribution center from a navigation apparatus installed in the vehicle;

obtaining, through the communication unit, current traffic information which includes congested road information that indicates the presence of congestion, and no-congestion road information that indicates the absence of congestion;

generating predicted traffic information, by operation of a CPU in the traffic distribution center, according to the time the vehicle arrives at each road in a route to a destination, based on the vehicle information, the predicted traffic information including congested road information that indicates the presence of congestion, and no-congestion road information that indicates the absence of congestion;

by operation of the CPU, determining whether or not the predicted traffic information for a road is different from the current traffic information for the road, extracting the predicted traffic information for the road if determined to be different from the current traffic information for the road, and not extracting the predicted traffic information for the road if both the predicted traffic information and the current traffic information are determined to be the no-congestion road information;

distributing, through the communication unit, the predicted traffic information extracted in the predicted traffic information extracting step to the navigation apparatus.

* * * * *